US008127776B2

(12) United States Patent
Green

(10) Patent No.: US 8,127,776 B2
(45) Date of Patent: Mar. 6, 2012

(54) COSMETIC DEVICE FOR APPLICATION AND REMOVAL OF FALSE EYELASHES

(76) Inventor: Pamela Green, Richmond, CA (US)

( * ) Notice: Subject to any disclaimer, the term of this patent is extended or adjusted under 35 U.S.C. 154(b) by 416 days.

(21) Appl. No.: 12/378,774

(22) Filed: Feb. 18, 2009

(65) Prior Publication Data

US 2009/0223534 A1 Sep. 10, 2009

Related U.S. Application Data

(60) Provisional application No. 61/029,490, filed on Feb. 18, 2008.

(51) Int. Cl.
*A45D 40/30* (2006.01)

(52) U.S. Cl. ..... 132/216

(58) Field of Classification Search ..... 132/216–217, 132/320

See application file for complete search history.

(56) References Cited

U.S. PATENT DOCUMENTS

2007/0163613 A1* 7/2007 Lee ..... 132/216

* cited by examiner

*Primary Examiner* — Rachel Steitz
(74) *Attorney, Agent, or Firm* — Walt Froloff

(57) ABSTRACT

The present invention describes a. a cosmetic device for applying or removing false eyelashes. A handle is used for opening and closing two stems forming two 3D conforming surface pieces having mating surfaces with pads on each mating surface. Each pad is coupled to a mating surface end band region and the pads are used for attaching flattened false eye-lashes onto conforming eye-lids whereby solution placed on the pads as adhesive or remover either adheres the false eye-lash to the eyelid or chemically strips the false eye-lash adhesive onto or away from the eye-lid respectively.

5 Claims, 6 Drawing Sheets

COSMETIC DEVICE FOR APPLICATION AND REMOVAL OF FALSE EYELASHES

CROSS-REFERENCE TO RELATED APPLICATION

This application is a Non-Provisional based on Provisional Patent Application No. 61/029,490 filed on Feb. 18, 2008

BACKGROUND

Field of the Invention

The present invention relates generally cosmetics, and particularly for applying and removing false eye lashes.

Fake or eyelash extensions have become increasingly popular in the U.S. in recent years and can be bought from popular supermarkets and cosmetic stores. Long eyelashes are considered a sign of femininity in many cultures. Accordingly, some women seek to enhance their eyelash length artificially. In some cultures, the women pluck their eyelashes completely. This however is not the custom or practice here. Modern eye makeup includes mascara, eyeliner, eye putty and eye shadow emphasize the eyes. The twentieth century saw the beginning of convincing-looking false eyelashes, popular in the 1960s.

Eyelash-curling device abound in the marketplace. These generally have a handgrip which can be held in the hand, a shaft is rotatably mounted on the handgrip and a brush mounted on the shaft which is rotatable with the shaft. As the brush engages and twirls the eyelashes, the lashes are groomed, curled and separated. While these eyelash devices work on false or natural eyelashes, they do not aid in removing or re-applying false eyelashes.

Yet other eyelash devices includes a handle of a substantially flat profile, whose first end with an applicator element having a free end. The applicator element is formed by a blade defining a unitary structure elastically deformable in a multidirectional mode, and disposed substantially parallel to a plane of the handle. The blade has two main sides, the surface of at least one of the sides having reliefs capable of retaining some of the application product after a substantial portion of the surface has been brought into contact with the product. The width of the free end, measured along a first direction parallel to the plane, is at least equal to a quarter of the average width of an arc of eyelashes. These type of applicators are concerned with the coloring and texturing of the eyelashes themselves.

Removing false eyelashes is time consuming, exacting, painful and difficult at best. One may have to more than gently tug on the false lashes for removal. In so doing, the natural eyelashes may be damaged or injured. Pulling and tugging at the natural eyelashes in the removal process at times causes the natural eyelashes to be ripped out at the root, along with the false eyelashes. This can damage the follicles of the natural eyelashes and the natural re-growth. As a result, the health of the natural eyelashes. What is needed are ways to remove the false eyelashes while allowing continuing healthy growth of the natural eyelashes.

What is needed are ways that prevent damage to the natural lashes in the application of and removal of false eyelashes and other cosmetic devices dealing with small delicate tissue and areas. In addition, the removal or application of false eyelashes must be done in a very still environment, and also safely. What is needed are cosmetic devices that allow safe application an removal of false eyelashes

SUMMARY

The present invention discloses a cosmetic device for applying or removing false eyelashes. A handle that accommodates a thumb and at least one finger is used for opening and closing two stems forming two 3D conforming surface pieces manipulable through a pivoting point coupling base. The 3D surface pieces are formed from a 3D trapezoidal shaped surface with small dimension ends coupled to the handle through base coupler and extending with curvature from an outward projected handle axis, with the surface piece distal ends curved radially to a tangent line perpendicular to the handle extension axis and having mating surfaces with pads on each mating surface. Each pad is coupled to a mating surface end band region and the pads are used for attaching flattened false eye-lashes onto conforming eye-lids whereby solution placed on the pads as adhesive or remover either adheres the false eye-lash to the eyelid or chemically strips the false eye-lash adhesive onto or away from the eye-lid respectively.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

There are several objects or advantages of the present invention. First, to make a cosmetic device for removing false eyelashes without irreparably damaging one's natural eyelashes.

It is another object of the present invention to provide a way to apply false eyelashes without tearing one's natural eyelashes.

It is yet another object of the present invention to provide a way to apply false eyelashes to one's self, quickly, painlessly and expertly without expensive professional help.

Embodiments of the Invention

Figure 1:
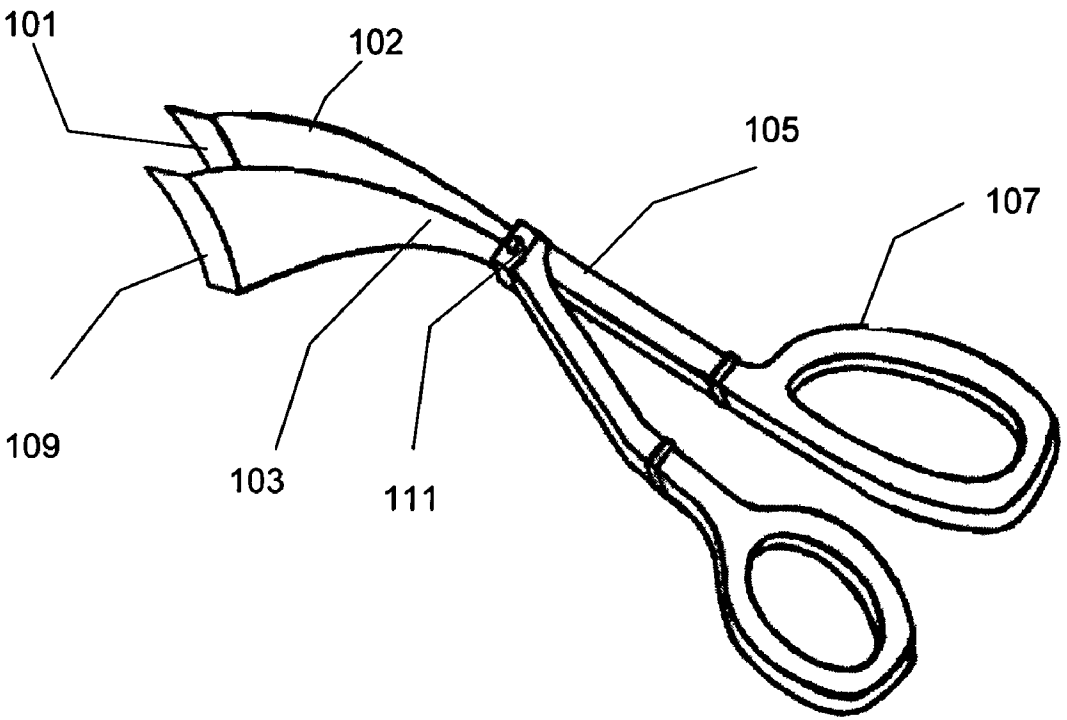
FIG. 1 is a perspective view of a cosmetic device for applying or removing false eyelashes in accordance with an embodiment of the invention.

FIG. 1 is a perspective view of a cosmetic device for applying or removing false eyelashes in accordance with an embodiment of the invention. Asdf An embodiment of the invention cosmetic device shows a handle 105 that accommodates a thumb and at least one finger 107. The handle is used for opening and closing two stems forming two 3D conforming surface pieces 102 103 from pivoting point coupling base 111. The handle 105 107 is used for opening and closing from two stem structures 102 103 forming two 3D conforming surface pieces 101 109 manipulable through a pivoting point coupling base 111. The 3D surface pieces 102 103 are formed from a 3D trapezoidal shaped surface with small dimension ends 103 coupled to the handle 105 through base coupler 111 and extending with curvature from an outward projected handle axis. The surface piece distal ends 109 are curved radially to a tangent line perpendicular to the handle extension axis and having mating surfaces with pads 101 on each mating surface distal end 109. Each distal end has a pad coupled to a mating surface end band region 109.

Figure 2:
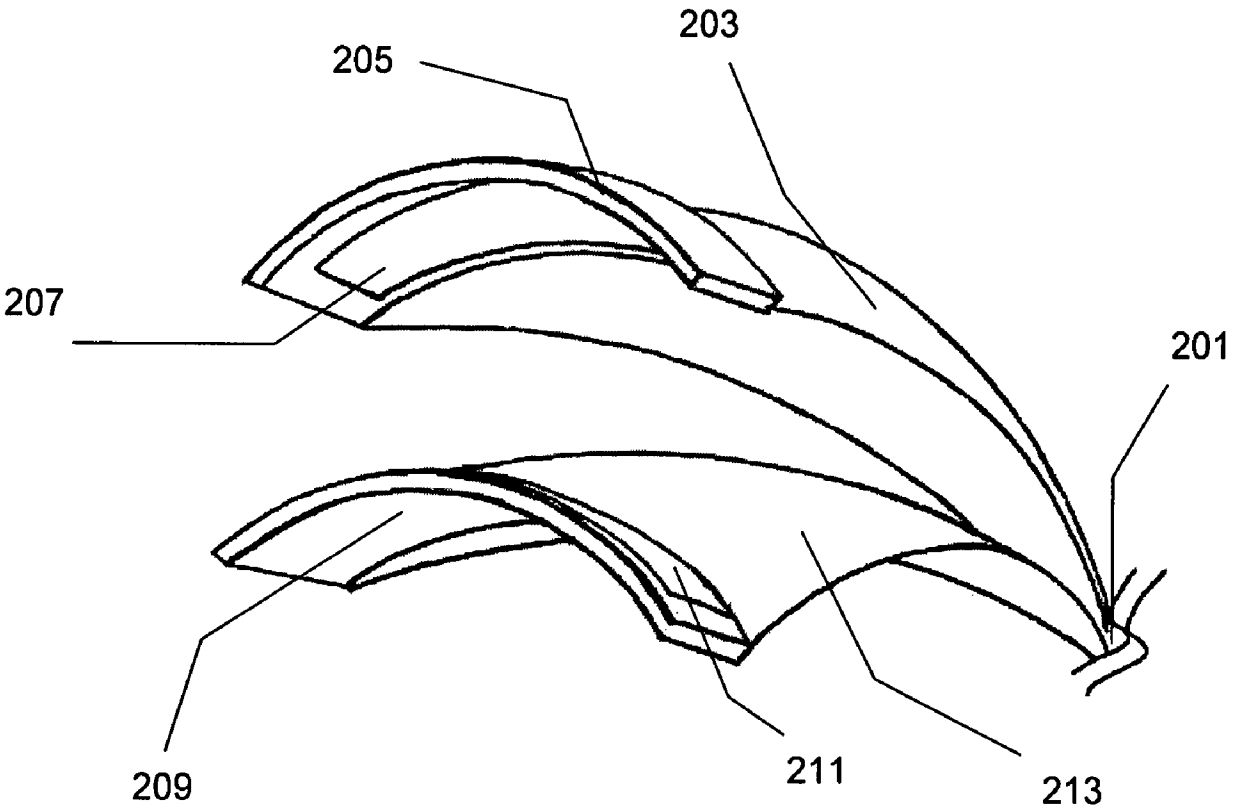
FIG. 2 is a perspective detail view of a cosmetic device clamp-like base element distal end for applying or removing false eyelashes in accordance with an embodiment of the invention.

FIG. 2 is a perspective view of a cosmetic device clamp-like base element distal end for applying or removing false eyelashes in accordance with an embodiment of the invention. The two stem surface elements 203 213 extend from the base pivot 201 into a somewhat rectangular curved distil end 209 205 each with pads 207 211 adhering to the inside mating surface of each distal end. The pads are cotton strips or of softer and absorbent material for holding solution for dissolving a glue substance from the false eyelash or containing glue for adhering the false eyelash onto the eyelid. Thus the curvature of the end conforms somewhat to the eyelid for securing or removing a false eyelash with the device.

Figure 3:
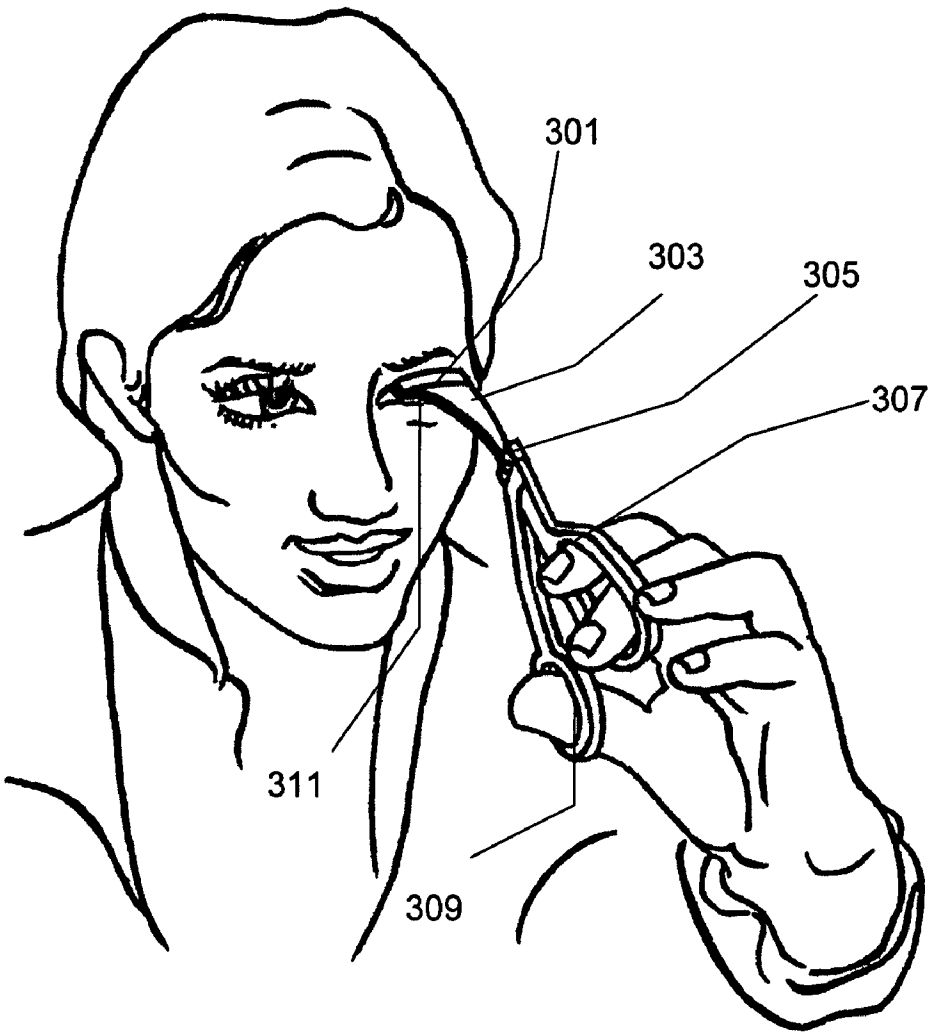
FIG. 3 is a perspective view a cosmetic device for applying or removing false eyelashes being used in accordance with an embodiment of the invention.

FIG. 3 is a perspective view a cosmetic device for applying or removing false eyelashes being used in accordance with an embodiment of the invention. The embodiment shows the grasp holding via the hand grip 307 309 manipulating the eyelash pads on the stem 303 distal ends 301 311 through the base pivot 305. The hand open-close sandwich the false eyelash for placement or removal to or from the eyelash.

Figure 4:
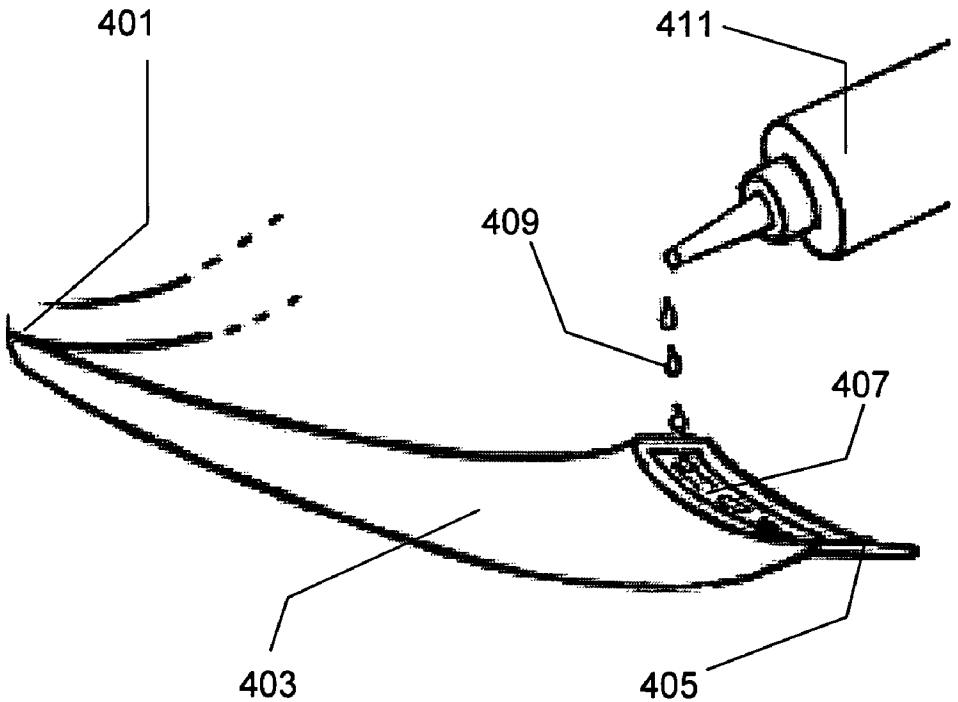
FIG. 4 illustrates the step of applying solution to the pad in accordance with an aspect of the invention.

FIG. 4 illustrates the step of applying solution to the pad in accordance with an aspect of the invention. The pads 407 are made substantially of cotton strips coupled with adhesive 409 to the eye-lash engaging distal ends 405. The distal end 405 is rigidly coupled to the base pivot 401 via the flared stem 403. The solution 409 used for dissolving the eyelash glue or the glue for adhering the false eyelash can be squeezed from a tube 411 directly onto the cotton strip pad 407.

Figure 5:
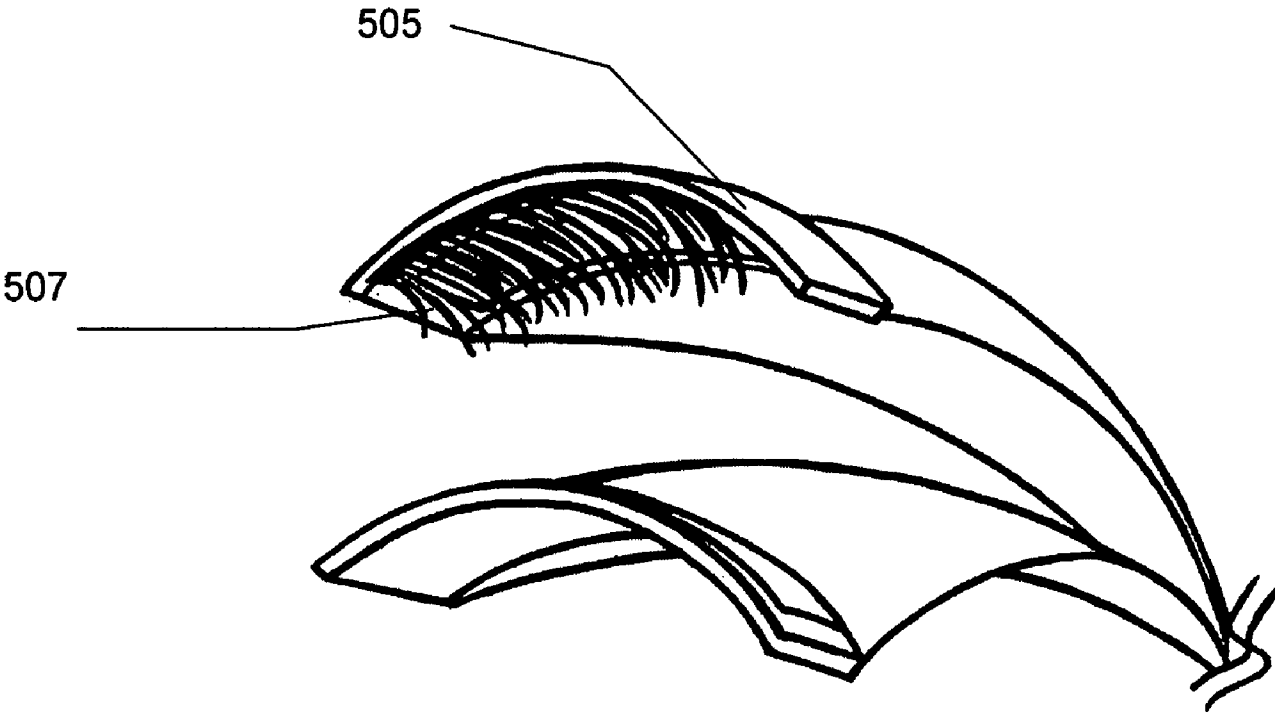
FIG. 5 illustrates the adhesive action on the eyelash by the pads on the distal end in accordance with an aspect of the invention.

FIG. 5 illustrates the adhesive action on the eyelash by the pads on the end in accordance with an aspect of the invention. The pad 505 on the distal end 505 of the device will engage the false eyelash on the eyelid for a short period of time, perhaps 3 seconds depending on the dissolver action, before the false eyelash will adhere to the pad and can be removed. Both top and bottom pads can have dissolver solution or adhesive to add strength to the removal or application respectively.

Figure 6:
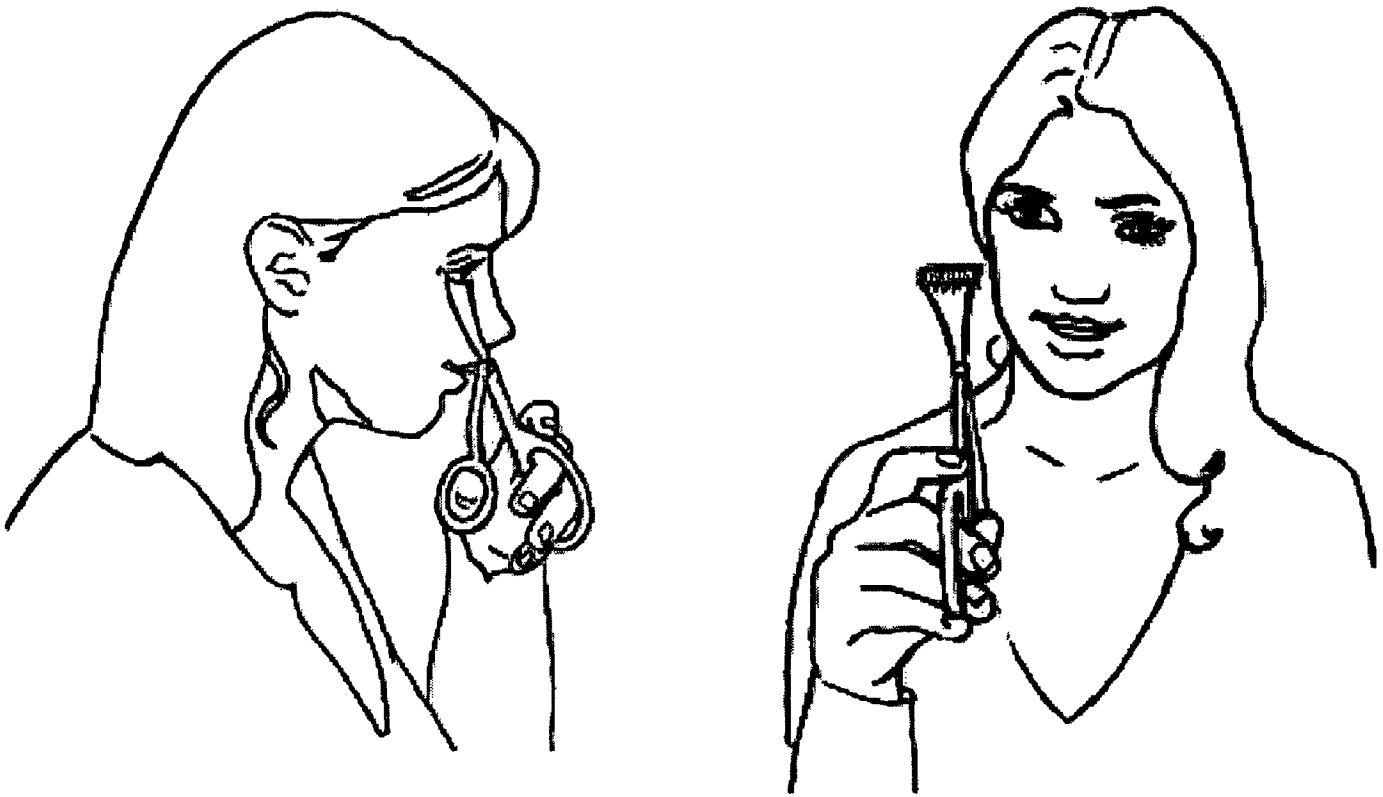
FIG. 6 illustrates the step of removing false eyelashes in accordance with an aspect of the invention.

FIG. 6 illustrates the step of removing false eyelashes in accordance with an aspect of the invention. The device embodiment is shown engaged with the eyelid and false eyelash for a short period of time for the dissolver to chemically alter the glue holding the false eyelash to the eyelid. Once the glue has lost its adhesiveness due to the dissolver, the false eyelash will adhere to the device pad and can be safely removed, leaving the real eyelash intact.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A cosmetic device for applying or removing false eyelashes, comprising:

a handle that accommodates a thumb and at least one finger;

the handle used for opening and closing from two stems forming two 3D conforming surface pieces manipulable through a pivoting point coupling base;

the 3D surface pieces formed from a 3D trapezoidal shaped surface with small dimension ends coupled to the handle through base coupler and extending with curvature from an outward projected handle axis;

the surface piece distal ends are curved radially to a tangent line perpendicular to the handle extension axis and having mating surfaces with pads on each mating surface;

each pad coupled to a mating surface end band region; and the pads used for attaching flattened false eye-lashes onto conforming eye-lids whereby solution placed on the pads as adhesive or remover either adheres to the false eye-lash or chemically strips the false eye-lash adhesive onto or away from the eye-lid respectively.

2. The device for applying or removing false eyelashes as in claim 1 wherein the handle is a scissor-like handle with thumb and forefinger placement holds.

3. The device for applying or removing false eyelashes as in claim 1 wherein the device is made of material essentially from a group of materials consisting of plastic, metal, composite and wood.

4. The device for applying or removing false eyelashes as in claim 1 wherein the pads are made substantially of cotton strips with adhesive to the eye-lash engaging distal ends.

5. The device for applying or removing false eyelashes as in claim 1 further comprising the placing of dissolver solution which must be in contact with the eyelash adhesive for a short period before extraction may proceed.

* * * * *